United States Patent [19]

Kracklauer

[11] 4,389,220

[45] Jun. 21, 1983

[54] METHOD OF CONDITIONING DIESEL ENGINES

[75] Inventor: John J. Kracklauer, Longmont, Colo.

[73] Assignee: Syntex (U.S.A.) Inc., Palo Alto, Calif.

[21] Appl. No.: 156,301

[22] Filed: Jun. 4, 1980

[51] Int. Cl.[3] ..... C10L 1/08

[52] U.S. Cl. ..... 44/57; 44/68; 123/569; 123/1 A; 123/198 A

[58] Field of Search ..... 44/57, 68; 123/569, 123/1 A, 198 A

[56] References Cited

U.S. PATENT DOCUMENTS

| | | | |
|---|---|---|---|
| 2,791,597 | 5/1957 | Anzilotti et al. | 44/68 |
| 3,144,857 | 8/1964 | Hesselberg | 123/198 A |
| 3,294,685 | 12/1966 | Stevens et al. | 44/68 |
| 3,341,311 | 9/1967 | Pedersen | 44/68 |
| 3,535,356 | 10/1970 | Hartle et al. | 44/68 |
| 4,002,151 | 1/1977 | Toyoda et al. | 123/1 A |
| 4,161,160 | 7/1979 | Hicks et al. | 123/1 A |

*Primary Examiner*—Charles F. Warren
*Assistant Examiner*—Y. Harris-Smith
*Attorney, Agent, or Firm*—John A. Dhuey; Joseph I. Hirsch

[57] ABSTRACT

A method of conditioning diesel engines is described. In accordance with the method, a diesel engine is operated on a diesel fuel containing from about 20-30 ppm of dicyclopentadienyl iron or an equivalent amount of a derivative thereof for a period of time sufficient to eliminate carbon deposits from the combustion surfaces of the engine and to deposit a layer of iron oxide on the combustion surfaces, which layer is effective to prevent further buildup of carbon deposits, and subsequently the diesel engine is operated on a maintenance concentration of from about 10–15 ppm of dicyclopentadienyl iron or an equivalent amount of a derivative thereof on a continuous basis. The maintenance concentration is effective to maintain the catalytic iron oxide layer on the combustion surfaces but insufficient to decrease timing delay in the engine.

6 Claims, No Drawings

METHOD OF CONDITIONING DIESEL ENGINES

BACKGROUND OF THE INVENTION

1. Field of the Invention

The present invention is concerned with a method of conditioning a diesel engine. In particular, it is concerned with a method of conditioning a diesel engine employing a first concentration of dicyclopentadienyl iron or a derivative thereof in the diesel fuel to remove carbon deposits from the combustion surfaces of the engine and to deposit a layer of catalytic iron oxide on the combustion surfaces to prevent further buildup of carbon deposits, and subsequently operating the diesel engine on a fuel containing a reduced, maintenance concentration of dicyclopentadienyl iron or a derivative thereof sufficient to maintain the catalytic iron oxide layer but insufficient to decrease timing delay in the engine.

2. State of the Art

The use of dicyclopentadienyl iron or derivatives thereof to reduce smoke opacity, smoke quantity and engine carbon deposits in diesel engines is known in the art. Various applications of the aforementioned fuel additives are described in U.S. Pat. No. 3,294,685; U.S. Pat. No. 3,341,311; Canadian Pat. No. 907,325; Canadian Pat. No. 909,509; British Pat. No. 1,477,806; and British Pat. No. 1,477,807.

SUMMARY OF THE INVENTION

The prior art methods for obtaining improved operation of diesel engines typically utilize a fixed amount of diesel fuel additive such as dicyclopentadienyl iron or derivatives thereof for continuous operation of a diesel engine. A new method has now been discovered in which a diesel engine is operated on a diesel fuel containing an additive, such as dicyclopentadienyl iron or a derivative thereof, according to a method which conditions the diesel engine in an initial period at a first additive concentration followed by further continuous operation of the diesel engine at a reduced additive level.

Accordingly, the present invention relates to a method of conditioning a diesel engine comprising the steps of operating a diesel engine on a diesel fuel containing about 10 to 16 milligram moles, based on the dicyclopentadienyl iron moiety, per 100 kilograms of the diesel fuel, of a diesel fuel-soluble organometallo compound selected from the group consisting of dicyclopentadienyl iron, mono- and di-lower alkyldicyclopentadienyl iron derivatives; mono- and di-lower alkanoyl-dicyclopentadienyl iron derivatives; dimer and polymer reaction products of dicyclopentadienyl iron or lower mono- and di-lower alkyl substituted derivatives thereof; and mixtures thereof for a period of time sufficient to remove carbon deposits present on the combustion surfaces on the diesel engine and to deposit a layer of catalytically active iron oxide on the combustion surfaces of the diesel engine effective to prevent further formation of carbon deposits, and thereafter operating the diesel engine for an extended period of time on a diesel fuel containing a reduced amount of a diesel fuel soluble organometallo compound selected from the aforementioned group, the reduced amount of diesel fuel soluble organometallo compound being sufficient to maintain an effective amount of a catalytically active iron oxide layer on the combustion surfaces of the diesel engine to prevent formation of carbon deposits thereon but insufficient to decrease timing delay in the diesel engine. The lower alkyl or lower alkanoyl moieties referred to above may each have 1 to 8 carbon atoms.

DETAILED DESCRIPTION OF THE INVENTION

The method of this invention employs an initial break-in or conditioning period utilizing a diesel fuel containing a high level of a diesel fuel soluble organometallo compound, i.e. a dicyclopentadienyl iron compound or derivative thereof, and a maintenance period of continuous operation utilizing a reduced amount of a diesel fuel soluble organometallo compound, i.e. a dicyclopentadienyl iron compound or derivative thereof. The deleterious effects of carbon buildup in diesel engines has been well documented in the literature. Particularly with respect to diesel engines, carbon buildup can create increased amounts of smoke and greater smoke opacity in exhausts. Furthermore, such carbon deposits can cause precombustion within the combustion chambers of a diesel engine resulting in power loss and decreased efficiency in burning of the fuel. Prior art methods for correcting such problems have typically dealt with the addition of a fixed amount of a dicyclopentadienyl iron compound or derivative thereof to the diesel fuel supplied to the diesel engine during its operation. While those methods have been successful to some extent to reduce smoke opacity and smoke quantity generated by a diesel engine, they have not been entirely satisfactory in all respects.

It is now been discovered that while dicyclopentadienyl iron compounds and derivatives thereof have certain beneficial effects when supplied in a diesel fuel, high levels of those additives in a diesel fuel can create a problem relating to "effective knock" in the diesel engine, i.e., the additive creates a decrease in timing delay present in the diesel engine. That decrease in timing delay results in a certain amount of precombustion and disruption of the fuel burning cycle of the diesel engine with a corresponding decrease in power output and an increase in fuel consumption. Such effects have been noted with dicyclopentadienyl iron concentrations as low as 20+ppm.

While high concentrations of dicyclopentadienyl iron and its derivatives are beneficial in obtaining rapid removal of carbon deposits from the combustion surfaces of a diesel engine, continued operation of a diesel engine with a diesel fuel containing such high levels of the additive is not entirely beneficial due to the decrease in timing delay of the diesel engine operation discussed above. It has now been discovered that the beneficial effects of the dicyclopentadienyl iron compound and derivatives thereof in diesel fuels can be seen during further operation of a diesel engine by employing a conditioning program for the diesel engine having an initial break-in period, during which a high concentration of dicyclopentadienyl iron (i.e. 20–30 ppm) or an equivalent amount of a derivative thereof is employed for a period of time sufficient to substantially eliminate the carbon deposits on the combustion surfaces of the diesel engine and to deposit a catalytically active layer of iron oxide on the combustion surfaces, and then reducing the concentration level of the dicyclopentadienyl iron or a derivative thereof to a level which maintains a catalytically active iron oxide layer on the combustion surfaces but does not decrease timing delay in the engine. Typically, maintenance levels in the range of 10–15 ppm of dicyclopentadienyl iron or an equivalent amount of its derivatives are considered to be satisfactory.

The initial break-in period or conditioning period, at which a high level of the dicyclopentadienyl iron additive or derivatives thereof is employed in the diesel fuel, should be of a sufficient length to effectively eliminate any carbon deposits which are presently on the combustion surfaces of the diesel engine prior to application of fuel containing the dicyclopentadienyl iron or its derivatives. That period of time should also be sufficient to deposit a catalytically active layer of iron oxide on the combustion surfaces to prevent further buildup of carbon deposits during continued operation of the diesel engine. It is apparent that the exact length of time during which a diesel engine should be operated on the high level concentration of additive will be determined by the condition of the engine prior to the break-in period. For example, engines having high levels of carbon deposits may require a longer break-in period that new engines having no carbon deposits or those engines which have minimal carbon deposit buildup. For new engines, typically the period for break-in can be as short as 2 months (i.e. approximately two hundred engine operating hours). That length of operation is considered sufficient to deposit a catalytically active layer of iron oxide on the combustion surfaces which prevents additional carbon buildup on those combustion surfaces. For engines which have been operated for a period of time without the diesel fuel additive, a break-in period of 3–6 months (i.e. about 400–1,000 engine operating hours) is considered to be satisfactory.

While the exact quantity of catalytically active iron oxide which is deposited on the combustion surfaces is not known, it has been determined that that layer is at least mono-molecular and less than that which would be termed a scale quantity of iron oxide. The catalytic activity of the iron oxide layer appears to be due to its formation under the severe conditions present in the diesel engine during the combustion process. The catalytically active layer of iron oxide effectively eliminates formation of carbon deposits on the combustion surfaces.

Once the break-in period has resulted in the removal of carbon deposits on the combustion surfaces and the deposit of a catalytically active layer of iron oxide on those surfaces, the level of dicyclopentadienyl iron on a derivative thereof in the diesel fuel can be reduced to a range of about 10–15 ppm. The exact maintenance level of fuel additive will depend on the operating characteristics of the engine and the condition of the engine at the end of the break-in period. It is only required that the amount of the fuel additive be reduced to a level such that "effective knock" is eliminated during the operation of the diesel engine and maintained at a high enough level such that the catalytically active iron oxide layer which is deposited on the combustion surfaces is effectively maintained to prevent further formation of carbon deposits on the combustion surfaces.

Typically, the end of the break-in period will correspond to a time at which about a 3–5% increase in miles per gallon for the operation of the diesel engine is obtained. Additional increases in fuel economy in the range of 2–4% may then be obtained by reducing the dicyclopentadienyl iron additive concentration to a maintenance level as discussed hereinbefore. Alternatively, the end of the break-in period can be determined by disassembling the diesel engine at specific intervals to determine when the carbon deposit is gone and when a red iron oxide layer has been deposited on the combustion surfaces. Further operation of the engine after removal of the carbon deposits and formation of the red iron oxide layer at the maintenance level of additive described herein results in continued improved operation of the diesel engine. The maintenance level of dicyclopentadienyl iron or the equivalent amount of a derivative thereof may be determined for a particular engine by step-wise decreasing of the dicyclopentadienyl iron concentration in the diesel fuel from the break-in level until no further increase in fuel economy is observed.

In some instances, such as for fleet operation of diesel powered vehicles, it is not always desirable to tailor a fuel formulation to a specific engine. Rather, bulk formulations of the diesel fuel and the dicyclopentadienyl iron moiety will be prepared and employed in each vehicle in the fleet without regard to particular engine condition. In those instances, during the break-in period, it is considered satisfactory to employ a diesel fuel containing about 20–30 ppm by weight of dicyclopentadienyl iron (i.e., from about 10 to 16 milligram moles per 100 kilograms of fuel) or a mole equivalent amount (based on the dicyclopentadienyl iron moiety) of a suitable derivative thereof. During the maintenance period, a satisfactory maintenance concentration is considered to be about 10–15 ppm of dicyclopentadienyl iron (i.e., about from 5 to 8 milligram moles per 100 kilograms of fuel) or a mole equivalent amount (based on the dicyclopentadienyl iron moiety) of a suitable derivative thereof.

The fuel additives useful in the present invention encompass dicyclopentadienyl iron and derivatives thereof including dimers and polymers of dicyclopentadienyl iron having a dicyclopentadienyl iron nucleus or moiety. Where derivatives are used, the quantity of derivative used is adjusted to provide from about 10 to 16 milligram moles per 100 kilograms of fuel during the break-in period and from about 5 to 8 milligram moles per 100 kilograms of fuel during the maintenance period. In the case of simple derivatives, such as methyldicyclopentadienyl iron, which contain one mole of dicyclopentadienyl iron per mole of derivative, an equal mole amount is used. Whereas in the case of derivatives containing more than one mole of dicyclopentadienyl iron per mole of derivative (e.g., dimers or polymers), the prescribed range in the break-in or maintenance period will be divided by the number of dicyclopentadienyl iron moieties or nuclei in the derivative molecule. The derivative should also be soluble in the fuel at the concentration at which it is added. Mixtures of such derivatives and mixtures of dicyclopentadienyl iron with one or more of such derivatives can also be used. Suitable dicyclopentadienyl iron derivatives which can be used include, for example, mono- and di-lower alkyl dicyclopentadienyl iron, for example ethyl-dicyclopentadienyl iron, n-butyldicyclopentadienyl iron, dimethyldicyclopentadienyl iron, di-(ethyldicyclopentadienyl) iron, ethyl-dicyclopentadienyl iron, di-(heptylcyclopentadienyl) iron and the like; mono- and di-lower alkanoyl dicyclopentadienyl iron, e.g., butyryldicyclopentadienyl iron, di(acetylcyclopentadienyl) iron, acetyldicyclopentadienyl iron, butyryldicyclopentadienyl iron, dibutyryldicyclopentadienyl iron, di-(hexanoylcyclopentadienyl) iron and the like; dimer and polymer reaction products of dicyclopentadienyl iron or lower mono- and di-alkyl substituted derivatives thereof, e.g., 2,2-di(ethyldicyclopentadienyl iron)-propane, di-(butyldicyclopentadienyl iron)-methane, di-(dicyclopentadienyl iron-(methane and the like. The lower alkyl or lower alkanoyl moieties referred to above may each have 1 to 8 carbon atoms.

Dicyclopentadienyl iron and the derivatives enumerated above are known compounds and can be prepared according to known procedures or by obvious modifications thereof; note, for example, U.S. Pat. Nos. 2,769,828; 2,834,796; 2,898,360; 3,035,968; 3,238,185; 3,437,634 and J.A.C.S., Volume 74, page 3458 (1952). Dicyclopentadienyl iron itself is conventionally known in the art as ferrocene.

Since dicyclopentadienyl iron and its derivatives promote the oxidation of hydrocarbon fuels even prior to combustion and thus increase the likelihood of the formation of deleterious gum-like oxidation products, it may be desirable to employ, in combination with the dicyclopentadienyl iron additives, diesel fuel anti-oxidants and diesel fuel sludge dispersants to prevent or reduce the production of oxidation products and to disperse any oxidation products which may be formed to prevent possible fouling or gumming of the diesel engine fuel injectors. Useful diesel fuel anti-oxidants and diesel fuel sludge dispersants are described in British Pat. Nos. 1,477,806 and 1,477,807.

The dicyclopentadienyl iron or derivatives thereof can be applied directly to the diesel fuel at the refinery or tank farm or alternatively can be conveniently premixed in high concentrations in a diesel fuel or other inert organic solvent as a concentrate and added in the proper proportion directly to the engine fuel tank. The term "ppm" as used herein refers to parts by weight of additive per million parts by weight of diesel fuel. The term "diesel fuel" refers to a normally liquid hydrocarbon fuel described by ASTM as No. 2 fuel oil and can optionally contain various additives such as are conventionally used by the art.

While this invention has been illustrated with particular reference to the specific embodiments described in the specification, it should be understood by those skilled in the art that various changes may be made and equivalents may be substituted without departing from the true spirit and scope of the invention. All such modifications are intended to be within the scope of the claims appended hereto.

What is claimed is:

1. A method of conditioning a diesel engine comprising the steps of:

operating a diesel engine on a diesel fuel containing about 10 to 16 milligram moles, based on the dicyclopentadienyl iron moiety, per 100 kilograms of the diesel fuel, of a diesel fuel soluble organometallo compound selected from the group consisting of dicyclopentadienyl iron; mono- and di-lower alkyl dicyclopentadienyl iron derivatives; mono- and di-lower alkanoyl dicyclopentadienyl iron derivatives; dimer and polymer reaction products of dicyclopentadienyl iron or lower mono- and di-alkyl substituted derivatives thereof; said lower alkyl or lower alkanoyl moieties each having 1 to 8 carbon atoms therein; and mixtures thereof for a period of time sufficient to remove carbon deposits present on the combustion surfaces of the diesel engine and to deposit a layer of catalytically active iron oxide on the combustion surfaces of the diesel engine effective to prevent further formation of carbon deposits, and thereafter operating the diesel engine for an extended period of time on a diesel fuel containing a reduced amount of a diesel fuel soluble organometallo compound selected from the aforementioned group, said reduced amount of diesel fuel soluble organometallo compound being sufficient to maintain an effective amount of a catalytically active iron oxide layer on the combustion surfaces of the diesel engine to prevent formation of carbon deposits thereon but insufficient to decrease timing delay in the diesel engine.

2. The method of claim 1 wherein said reduced amount of diesel fuel soluble organometallo compound is between about 5 to 8 milligram moles, based on the dicyclopentadienyl moiety, per 100 kilograms of the diesel fuel.

3. The method of claims 1 or 2 wherein said diesel fuel soluble organometallo compound is selected from the group consisting of dicyclopentadienyl iron, ethyldicyclopentadienyl iron, n-butyldicyclopentadienyl iron, dimethyldicyclopentadienyl iron, di-(ethylcyclopentadienyl) iron, di-(heptylcyclopentadienyl) iron, acetyl-dicyclopentadienyl iron, di-(butyrylcyclopentadienyl) iron, di-(hexanoylcyclopentadienyl) iron, 2,2-di(ethyl-dicyclopentadienyl iron)-propane, di-(butylcyclopentadienyl iron)-methane, di-(dicyclopentadienyl iron)-methane and mixtures thereof.

4. The method of claims 1 or 2 wherein said diesel fuel soluble organometallo compound is dicyclopentadienyl iron.

5. The method of claims 1 or 2 wherein the period of operation of the diesel engine on a diesel fuel containing about 10 to 16 milligram moles, based on the dicyclopentadienyl iron moiety, per 100 kilograms of the diesel fuel, of said diesel fuel soluble organometallo compound is from about 2 to about 6 months, or equivalently about 200–1,000 engine operating hours.

6. The method of claims 1 or 2 wherein the diesel fuel contains a diesel fuel sludge dispersant, a diesel fuel anti-oxidant or a mixture thereof.

* * * * *